US005733856A

United States Patent [19]

Gopalkrishnan et al.

[11] Patent Number: 5,733,856

[45] Date of Patent: Mar. 31, 1998

[54] DETERGENCY BOOSTING POLYMER BLENDS AS ADDITIVES FOR LAUNDRY FORMULATIONS

[75] Inventors: Sridhar Gopalkrishnan, Woodhaven; Edward J. Parker, Riverview, both of Mich.; Richard J. Holland, Flanders, N.J.; Sonia Patterson, Detroit, Mich.

[73] Assignee: BASF Corporation, Mount Olive, N.J.

[21] Appl. No.: 225,018

[22] Filed: Apr. 8, 1994

[51] Int. Cl.[6] ..... C11D 3/36; C11D 1/66; C11D 3/60

[52] U.S. Cl. ..... 510/360; 510/361; 510/398; 510/476; 510/477; 510/533; 525/63

[58] Field of Search ..... 252/174.21, 174.22, 252/174.23, 174.24, DIG. 2, DIG. 15; 525/63

[56] References Cited

U.S. PATENT DOCUMENTS

| | | | |
|---|---|---|---|
| 4,471,100 | 9/1984 | Tsubakimoto et al. | 525/367 |
| 4,746,456 | 5/1988 | Kud et al. | 252/174.24 |
| 4,846,994 | 7/1989 | Kud et al. | 252/174.24 X |
| 4,846,995 | 7/1989 | Kud et al. | 252/174.24 X |
| 4,904,408 | 2/1990 | Kud et al. | 252/174.24 |
| 4,925,588 | 5/1990 | Berrod et al. | 252/174.23 |
| 4,999,869 | 3/1991 | Holland et al. | 8/115.62 |
| 5,126,069 | 6/1992 | Kud et al. | 252/174.23 |
| 5,156,906 | 10/1992 | Holland | 428/264 |
| 5,318,719 | 6/1994 | Hughes et al. | 252/174.24 |

FOREIGN PATENT DOCUMENTS 358473 3/1990 European Pat. Off. .

OTHER PUBLICATIONS

Bille et al., "Finishing for Durable Press Soil Release", *Textile Chemist & Colonist*, vol: 1, No. 27 (Dec. 31, 1969) pp. 600/23–607/30.

*Primary Examiner*—Douglas J. McGinty
*Attorney, Agent, or Firm*—Joanne P. Will

[57] ABSTRACT

A laundry detergency boosting polymer blend additive is made up of:

a) a graft copolymer of polyalkylene oxide with vinyl ester, the graft copolymer having a molecular weight within the range of about 5,000 to 50,000; and b) at least one polycarboxylate selected from the group consisting of acrylic/maleic acid copolymers having a molecular weight within the range of about 1,000 to 100,000, and polyacrylic acid having a molecular weight of from about 1,000 to 100,000. The polymer blend additive is effective in water with an ion hardness in the range of about 50 to 500 ppm. The detergency boosting performance of the polymer blend additive is maintained or increased as the concentration of the hardness ions in water is increased.

29 Claims, 3 Drawing Sheets

CUMLATIVE IMPROVEMENTS IN REFLECTANCE WITH SEBUM CLAY REPORTED RELATIVE TO CONTROL (NO POLYMER)

CUMULATIVE IMPROVEMENTS IN REFLECTANCE WITH SEBUM/CLAY REPORTED RELATIVE TO CONTROL (NO POLYMER)

INDIVIDUAL POLYMER COMPONENTS ARE 50:50 IN EACH BINARY BLEND COMPOSITION

INDIVIDUAL POLYMER COMPONENTS ARE 33:33:33 IN EACH TERNARY BLEND COMPOSITION

CUMULATIVE IMPROVEMENTS IN REFLECTANCE WITH SEBUM/CLAY REPORTED RELATIVE TO CONTROL (NO POLYMER)

INDIVIDUAL POLYMER COMPONENTS ARE 50:50 IN EACH BINARY BLEND COMPOSITION

INDIVIDUAL POLYMER COMPONENTS ARE 33:33:33 IN EACH TERNARY BLEND COMPOSITION

DETERGENCY BOOSTING POLYMER BLENDS AS ADDITIVES FOR LAUNDRY FORMULATIONS

FIELD OF THE INVENTION

The present invention relates to detergency boosting polymer blends, and to laundry formulation containing these blends as additives.

BACKGROUND OF THE INVENTION

The use of polycarboxylates in detergent formulas has provided multiple benefits such as calcium sequestration, crystal growth inhibition to minimize encrustation on fabrics, lime soap dispersancy, and particulate soil dispersion. Sequestration of hardness ions such as calcium and magnesium by the polycarboxylates softens the water and increases detergency. Also sequestration of hardness ions by the polycarboxylates prevents the precipitation of salts of anionic surfactants, which if allowed to occur will lead to reduced detergency. Dispersion of particulate soil such as clay by the polycarboxylates prevents the redeposition of soils on the fabric.

The detergency boosting performance of polycarboxylates of different molecular weights and in certain instances, of different acrylic/maleic ratios, varies depending on the type of stain/fabric employed in the study. For example, with polyacrylic acids, the detergency boosting performance is most notable on particulate soil removal on cotton fabric; an acrylic/maleic copolymer with a molecular weight of 70,000 gives superior oily soil removal on polyester and cotton/polyester blends compared to the polyacrylates.

Perhaps more importantly, a significant number of polycarboxylates, notably certain polyacrylic acids and acrylic acid/maleic acid copolymer blends, Show a marked loss of detergency boosting characteristics on all types of fabrics as the hardness of the water used in the laundry increases. This drawback may diminish the cleaning prowess of certain laundry detergents containing these polycarboxylates in those areas where high water hardness may be encountered, e.g. greater than about 200 ppm.

On the other hand, a graft copolymer of vinyl acetate with polyalkylene oxide exhibits great cleaning prowess at relatively high water hardness, e.g. 300 ppm, but the performance thereof suffers considerably in much softer water.

The art is now replete with the use of polycarboxylates as both soil release agents and anti-redeposition agents. Kud et al., U.S. Pat. No. 4,746,456, discloses graft copolymer of polyalkylene oxides and vinyl acetate as antiredeposition inhibitors. Holland et al., U.S. Pat. No. 4,999,869, discloses soil release properties of graft polymers of polyalkylene oxides and vinyl acetate. Holland et al., U.S. Pat. No. 5,156,906 also describes certain graft copolymers which are utilized in pretreatment of fabrics to impart soil release properties thereto.

Soil release finishes are applied to those fabrics woven from many synthetic fibers, and especially from polyester or blends comprising polyester and cotton fibers, which are often very difficult to clean with conventional washing apparatus, e.g. washing machines. Polyester fibers are relatively easy to stain with oily (lipophilic) soils, but at the same time are difficult to wet in aqueous solution due to their hydrophobicity. The soil release finishes are most often hydrophilic in nature and can thus enhance the wetting of the fabrics by detergent solutions. This in turn helps to promote the rollup of oily soils during the wash cycle. The soil is removed from the fabric and transferred to the detergent. Thus, these surface coatings are known to impart soil release properties to fibers and fabrics so treated. The soil release finish can also act as a barrier between the surface of the fabric and the soil.

Soil release finishes can be applied to textiles in a variety of ways. In some cases, a non-permanent coating can be deposited in the rinse cycle of a conventional laundry process. In instances where a more permanent finish is required, the overlayer can be "heat set" to the fabric by drying at elevated temperatures often with mechanical pressure on the textile. Often times, however, the surface coating and concomitant soil release capability is imparted to the fabric during a pretreatment process in which an aqueous bath is employed.

Distinct from the concept of "soil release" is what is referred to as "anti-soil redeposition". The latter is a process which prevents the redeposition of soil which has already dissolved or dispersed in the wash water. It is obvious that the functions of the detergents and the surface finishing chemicals must supplement each other in the anti-redeposition process. But although the anti-redeposition process is often confused with soil release, it is not the same thing. In fact, there is very little direct connection between the two. In this regard, see Bille et al., "Finishing for Durable Press and Soil Release", *Textile Chemist and Colorist*, vol. 1, No. 27 (1969).

Detergency boosting is a concept distinct from both soil release and antiredeposition. Soil release agents or additives are those that partition preferentially on the fabric surface, for example, polyester fabric, thus providing a hydrophilic sheath which improves the wetting of the fabric and also facilitates easy roll-up of oily soil. Detergency boosting primarily refers to additives that enhance the cleaning power of detergents. This is accomplished in more than one way. The additives can complex the hard water ions (calcium, magnesium, etc.) in the liquor, which if left in the wash water would cause the precipitation of the insoluble calcium or magnesium salt of anionic surfactants and thus lead to reduced detergency. Another mechanism by which additives enhance detergency is by the interaction of the additive with the soil. For example, clay soil constitutes an important type of particulate soil encountered during laundering of fabrics. The additive can form association complexes with the negatively charged clay particles and thus help weaken the cohesive forces of the soil with the fabric.

Anti-redeposition additives function very differently compared to detergency boosting additives. The phenomena of anti-redeposition comes into effect soon after the soil is removed from the garment and released in the wash water. Particulate soils such as clay can redeposit back onto the fabric and cause their "greying" or give a dulling effect to the fabrics. Thus, many commercial detergents use additives to minimize the redeposition of soils once they are released from the fabric. Generally these additives have the ability to keep the soil uniformly dispersed and suspended in the wash water. It is important to note that the ability of an additive to keep the soil suspended in the wash water should not be confused with the ability of the additive to facilitate removal of soil from the fabric. Cellulosic additives such as hydroxylethyl cellulose of carboxymethylcellulose have the ability to suspend the released soil and prevent their redeposition on the fabrics, but these additives are not known to remove soil from fabric surfaces. Thus, the objective of the present invention is to identify polymer blends which give acceptable detergency boosting performance both with oily and particulate soils and also show no appreciable loss in detergency as the water hardness is increased.

OBJECTS OF THE INVENTION

It is therefore an object of the present invention to provide a laundry polymer additive blend which will boost the detergency features of laundry formulations across a relatively wide range of water hardnesses.

Another object of the invention is to provide a laundry polymer additive blend whose detergency boosting properties will be maintained or even increased as the hardness of water is increased.

A further object of the present invention is to provide a laundry polymer additive blend made up of a graft copolymer of vinyl ester with polyalkylene oxide and one or more polycarboxylates.

An additional object of the invention is to provide a laundry detergent composition with a detergency boosting polymer additive blend whose efficacy will be maintained or increased as water hardness increases.

SUMMARY OF THE INVENTION

These and other objects of the invention are achieved by providing a laundry detergency boosting polymer additive blend. This polymer additive blend is made up of a graft copolymer of polyalkylene oxide with vinyl ester, such that the graft copolymer has a molecular weight within the range of about 5,000 to 50,000; and at least one polycarboxylate selected from the group consisting of acrylic/maleic acid copolymers having a molecular weight within the range of about 1,000 to 100,000, and polyacrylic acid having a molecular weight of from about 1,000 to 100,000. The claimed polymer blend is effective in water having an ion hardness in the range of about 50 to 500 ppm. The detergency boosting performance of the polymer additive blend is maintained or increased as the concentration of hardness ions in the laundry water is increased.

DETAILED DESCRIPTION OF THE PREFERRED EMBODIMENTS

Figure 1:
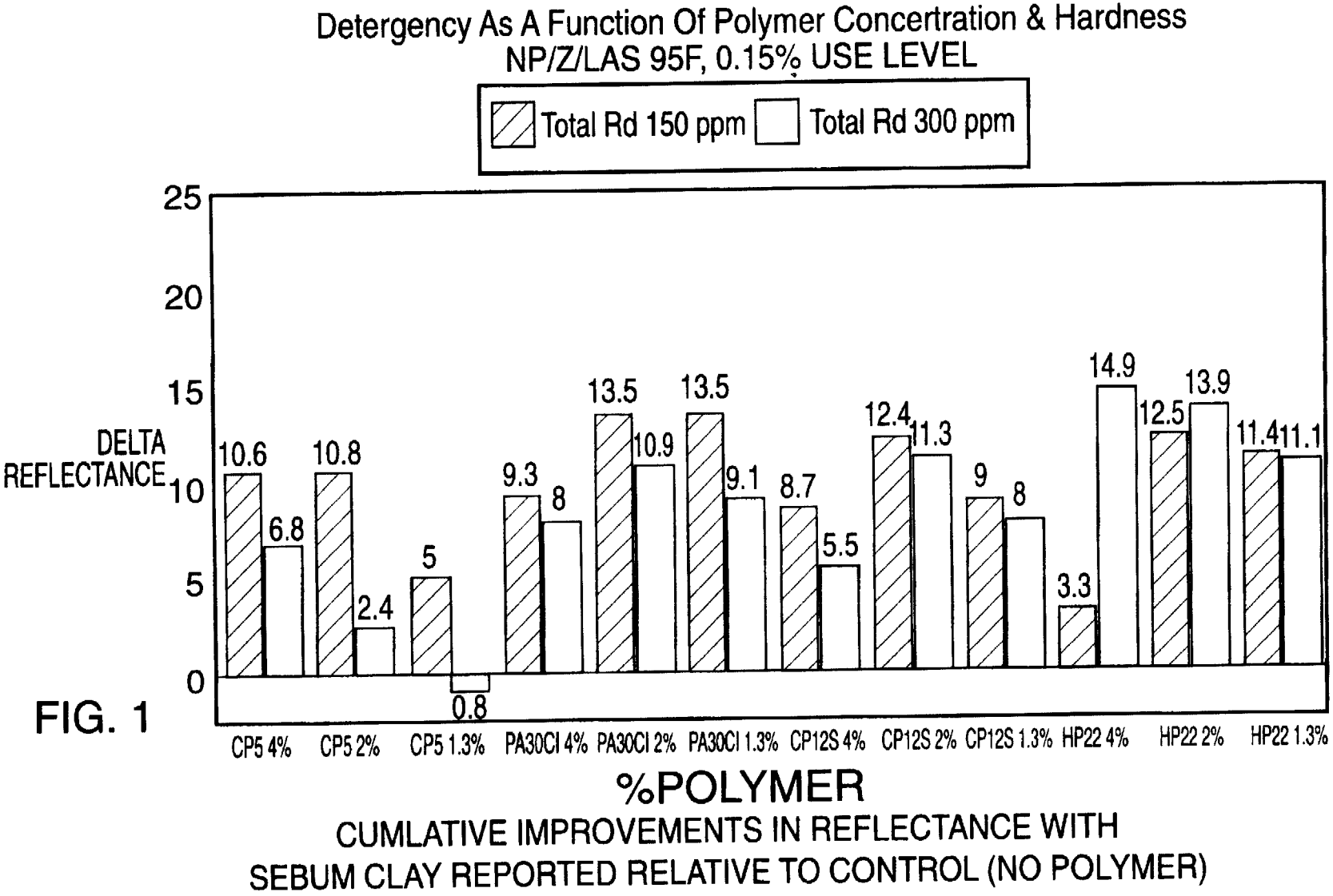
FIG. 1 is a bar chart of the detergency boosting performance of individual polymers as a function of polymer concentration.

The laundry additive polymer blend according to the various embodiments of the invention will contain a graft copolymer of polyalkylene oxide with vinyl ester. The vinyl esters are selected from the group of esters derived from saturated carboxylic acids containing about 1 to 6 carbon atoms, and mixtures thereof. These vinyl esters may include vinyl formate, vinyl acetate, vinyl propionate, vinyl butyrate, vinyl valerate, vinyl i-valerate and vinyl caproate. Of these, vinyl acetate and vinyl propionate are preferred, while vinyl acetate is particularly preferred.

The graft copolymer will have a molecular weight (all MW's herein expressed in terms of weight average molecular weight, unless otherwise specified) of about 5,000 to 50,000. More preferably, the graft copolymer will have a molecular weight within the range of about 10,000 to 35,000, more preferably within the range of about 15,000 to 30,000. In one especially desirable embodiment of the invention, the graft copolymer of polyalkylene oxide (preferably polyethylene oxide) with vinyl acetate will have a molecular weight of about 24,000. This graft copolymer is preferably obtained from BASF Corporation under the trademark SOKALAN® HP 22.

The graft copolymer according to the various aforesaid embodiments will comprise about 10 to 70% by weight of the polymer blend additive. In a more preferred embodiment, about 20 to 60% of the polymer blend will be the graft copolymer heretofore set forth. Another embodiment of the invention will have the graft copolymer making up from about 30 to about 55% of the polymer blend additive.

The graft copolymer as one component of the laundry additive blend of the invention may be synthesized in accordance with the procedures set forth in Holland et al., U.S. Pat. No. 4,999,869, incorporated herein by reference. Column 2, line 23 to column 4, line 68 of the '869 patent is especially salient. The polyalkylene oxide component of the graft copolymer may be selected from the group consisting of polyethylene oxide, polypropylene oxide and polybutylene oxide, including mixtures thereof. In a preferred embodiment herein, vinyl acetate is grafted onto polyethylene oxide.

The polycarboxylate component of the laundry polymer additive blend is selected from the group consisting of acrylic/maleic acid copolymers having a molecular weight within the range of about 1,000 to 100,000, and polyacrylic acid having a molecular weight of from about 1,000 to 100,000. The polycarboxylate component makes up about 10 to 70% by weight of the polymer blend, and more preferably from about 20 to 60% thereof. It is especially desirable that the polycarboxylate component comprise about 30 to 55% of the polymer blend additive.

The acrylic/maleic acid copolymers are selected from the group of compounds with the following formula:

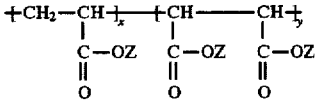

wherein z is hydrogen or an alkali metal, preferably sodium, and x and y are numbers such that the molecular weight of the acrylic/maleic acid copolymer is within the range of about 1,000 to 100,000, more preferably from about 2,000 to about 85,000, and even more desirably within the range of about 2,500 to about 75,000. In one especially preferred embodiment of the invention, the acrylic/maleic acid copolymer will have a molecular weight of about 70,000. This compound is also available from BASF under the trademark SOKALAN® CP 5. In another preferred embodiment of the invention, the acrylic/maleic acid copolymer will have a molecular weight of about 3,000. This copolymer may be obtained from BASF under the trademark SOKALAN® CP 12S.

The polycarboxylate component of the polymer blend additive may also be polyacrylic acid with a molecular weight within the range of about 1,000 to 100,000, more desirably from about 1,000 to 20,000, and even more preferably from about 1,000 to 10,000. In a more preferred embodiment, the polyacrylic acid has a molecular weight of about 8,000. This component may be obtained from BASF under the trademark SOKALAN® PA30Cl.

Both components making up the laundry detergent additive of the invention, the graft copolymer and polycarboxylate, can be added along with other detergent ingredients in a crutcher, and the slurry can then be subsequently spray dried to obtain the final powder detergent. Those skilled in the art of manufacture of detergents are aware of the varying conditions that can be used, depending upon the type of detergent that is produced. The type of formula, as well as economics, play a major role in determining the conditions for manufacture of each detergent. Particularly important is the temperature at which the detergent slurry is spray dried. The graft copolymer of the invention would be susceptible to hydrolysis under highly alkaline conditions or side chain cleavage under extreme temperatures. Thus, it may be preferable to add the graft copolymer as a post-additive to spray dried detergent powder.

The detergency boosting polymer blend additive according to the aforesaid embodiments may be added to laundry compositions suitable for washing clothing and fabrics, etc. The polymer blend additive will comprise from about 0.1 to 10% of the laundry formulation by weight. More preferably, a typical laundry formulation will contain about 0.5 to 7.5% of polymer blend additive. It is especially desirable that about 1 to 5% of the laundry composition be made up of the polymer blend additive of the invention.

The laundry formulations are typical of those utilized in the art. These will comprise about 10 to 70% of detergent active matter by weight, more preferably about 15 to 40%, and even more preferably about 25 to 35%. The detergent active matter may be selected from the group of anionic, nonionic, cationic, amphoteric and zwitterionic surfactants known to the skilled artisan. Examples of these surfactants may be found in McCutcheon, *Detergents and Emulsifiers* 1993, incorporated herein by reference. Examples of nonionic surfactants will include commonly utilized nonionic surfactants which are either linear or branched and have an HLB of from about 6 to 18, preferably from about 10 to 14. Examples of such nonionic detergents are alkylphenol alkoxylates (preferably ethoxylates) and alcohol ethoxylates. Examples of the alkylphenol alkoxylates include $C_6$–$C_{18}$ alkylphenols with about 1–15 moles of ethylene oxide or propylene oxide or mixtures of both. Examples of alcohol alkoxylates include $C_6$–$C_{18}$ alcohols with about 1–15 moles of ethylene oxide or propylene oxide or mixtures of both. Some of these types of nonionic surfactants are available from BASF Corp. under the trademark PLURAFAC. Other types of nonionic surfactants are available from Shell under the trademark NEODOL. In particular, a $C_{12}$–$C_{15}$ alcohol with an average of 7 moles of ethylene oxide under the trademark NEODOL® 25–7 is especially useful in preparing the laundry detergent compositions useful in the invention. Other examples of nonionic surfactants include products made by condensation of ethylene oxide with the reaction products of propylene oxide and ethylene diamine. Also included are condensation of ethylene oxide and propylene oxide with propylene glycol. Examples of such products are available from BASF under the trademark TETRONIC® and PLURONIC®, respectively. Other nonionic surface active agents also include alkylpolyglycosides, long chain tertiary amine oxides and phosphine oxides.

Typical anionic surfactants used in the detergency art include the synthetically derived water-soluble alkali metal salts of organic sulphates and sulphonates having about 6 to 22 carbon atoms. The commonly used anionic detergents are sodium alkylbenzene sulphonates, sodium alkylsulphates and sodium alkylether sulphates. Other examples include reaction products of fatty acids with isethionic acid and neutralized with sodium hydroxide, sulphate esters of higher alcohols derived from tallow or coconut oil, and alpha-methylestersulfonates.

Examples of amphoylitic detergents include straight or branched aliphatic derivatives of heterocyclic secondary or tertiary amines. The aliphatic portion of the molecule typically contains about 8 to 20 carbon atoms. Zwitterionic detergents include derivatives of straight or branched aliphatic quaternary ammonium, phosphonium or sulfonium compounds.

The laundry detergent formulations of the invention will also preferably contain one or more electrolytes. Electrolytes defined herein are any ionic water-soluble material. Electrolytes typically comprise from about 1 to 60% by weight, and more preferably about 25 to 35% of a laundry detergent formulation.

Examples of suitable electrolytes include sodium citrate and sodium carbonate. Potassium salts can also be incorporated to promote better solubility. In many cases the electrolyte utilized will also serve as the builder for enhancing detergency. The builder material sequesters the free calcium or magnesium ions in water and promotes better detergency. Additional benefits provided by the builder are increased alkalinity and soil suspending properties. With the near phase-out of phosphate in household laundry detergents, the most commonly used non-phosphate builders are the alkali metal citrates, carbonates, bicarbonates and silicates. All of these compounds are water-soluble. Water-insoluble builders which remove hardness ions from water by an ion-exchange mechanism are the crystalline or amorphous aluminosilicates referred to as zeolites. Mixtures of electrolytes or builders can also be employed. Secondary builders such as the alkali metals of ethylene diamine tetraacetic acid, nitrilotriacetic acid can also be utilized in the laundry formulations of the invention. Other secondary builders known to those skilled in the art may also be utilized.

The laundry detergent formulations heretofore described may also contain additional fillers and bulking agents, as well as dyes and perfumes known to those skilled in the art.

The polymer blend additives according to the various embodiments of the invention will boost the detergency of the aforesaid laundry formulations in water having hardness ions in the range of about 50 to 500 ppm, more preferably from about 100 to 450 ppm, and even more preferably from about 150 to 400 ppm, and perhaps most preferably from about 150 to 300 ppm.

As that term is used herein, "effective" means that the average cumulative or total $R_d$ (Delta Reflectance), hereinafter defined, will be equal to or greater that about 15.0 units, more preferably equal to or exceeding about 17.0 units. Just as importantly, the detergency boosting performance of the polymer blend additives is substantially maintained or even increased as the hardness of the water increases, even when the concentration of hardness ions in the water is doubled. The polymer blend additives exhibit a synergistic effect, over and above any one of the individual components alone, as the Examples herein demonstrate.

EXAMPLES

The following Examples will illustrate various aspects of the invention, but should not be construed as limiting the scope thereof:

Example 1

Laundry formulation:

| | |
|---|---|
| LAS | 17% (by weight) |
| NEODOL ® 25 - 7 | 0.5% |
| Zeolite A | 20% |
| Sodium Carbonate | 18% |
| Sodium Silicate | 5% |
| Sodium Sulfate | 37.5% |
| Polymer Blend Additive | As noted in the Examples |

LAS - Linear alkylbenzene sulfonate from Vista Chem. Co. under the trademark VISTA C-560 slurry. It is the sodium salt of a $C_{11}$–$C_{12}$ alkylbenzene sulfonic acid.
NEODOL ® 25 - 7 - Linear alcohol ($C_{12}$–$C_{15}$) with 7 moles EO obtained from Shell.
Zeolite A - from PQ Corp. under the trademark VALFOR 100.

Terg-o-Tometer tests were used to evaluate the detergency boosting properties of the polymer blend additives set forth herein. A non-phosphate powder detergent formulation built with sodium carbonate and zeolite A was used for all evaluations described in this invention. The composition of the detergent is shown above. The use level of this detergent was 1.5 g/L. Two different water hardness concentrations were used in the wash and rinse cycles, 150 ppm and 300 ppm. The Ca/Mg ratio was 2:1. The wash and rinse temperature was 95° F. The wash time was 10 minutes and the rinse time was 5 minutes. Two swatches with each of the following stain/fabric combinations were used in each pot: sebum/cotton, sebum/polyester, sebum/blend (DACRON® poly 65/C 35), clay/cotton, clay/polyester, clay/blend (65/35). These swatches were pre-stained and were obtained from Scientific Services of Middlesex, N.J. Additionally, one clean swatch of each fabric type was also added. Thus a total of 15 swatches were used in each pot. Each test also included a control where only the detergent was added and the polymer was omitted. The washed swatches were dried in a Whirlpool Imperial dryer.

Reflectance measurements of the stained swatch before and after the wash were determined using a Hunter colorimeter. The difference in the reflectance values of the washed swatches for each stain/fabric combination with the laundry detergent formulation containing the polymer blend additive or individual polymers as set forth below, and the washed swatches with laundry detergent formulation only (control) is reported in all Tables. This difference illustrates the enhancement in the detergency by the polymer or polymer blend relative to control. This difference is referred to as Delta Reflectance, or $R_d$. The 95% confidence intervals for each measurement are shown in parentheses.

The four individual polymers also chosen for evaluation were the following:

| | |
|---|---|
| Acrylic/Maleic Copolymer | MW = 70,000 (SOKALAN ® CP 5) |
| Acrylic/Maleic Copolymer | MW = 3000 (SOKALAN ® CP 12S) |
| Polyacrylic Acid | MW = 8000 (SOKALAN ® PA30C1) |
| Graft Copolymer of Polyethylene Oxide with Vinyl Acetate | MW = 24,000 (SOKALAN ® HP 22) |

TABLE 1 shows the detergency enhancement ($R_d$) provided by each of the above polymers (Examples 1–12), and the detergency enhancement provided by the polymer blend additives according to the various embodiments of the invention (Examples 13–22) at 150 ppm hardness concentration in water. Recording across TABLE 1, the detergency enhancement on each fabric/stain combination is shown. The cumulative or total enhancements in $R_d$ (Delta reflectance) is shown in the last column of TABLE 1. (In all examples herein, where a polymer blend is noted, the weight proportion for each individual polymer in the blend is the same. Thus in Example 13, there is about 50% of CP 5 and about 50% of HP 22 utilized in the blend. In Example 22, there is about 33% of CP 5, about 33% of PA 30Cl, and about 33% of HP 22 utilized in the blend).

TABLE 2 similarly shows the detergency enhancement for the above polymers (Examples 1–12), and the detergency enhancement provided by the polymer blend additives according to the various embodiments of the invention (Examples 13–22) at 300 ppm hardness concentration in water. Once again, the cumulative or total enhancement in $R_d$ is shown in the last column of TABLE 2.

Figure 2:
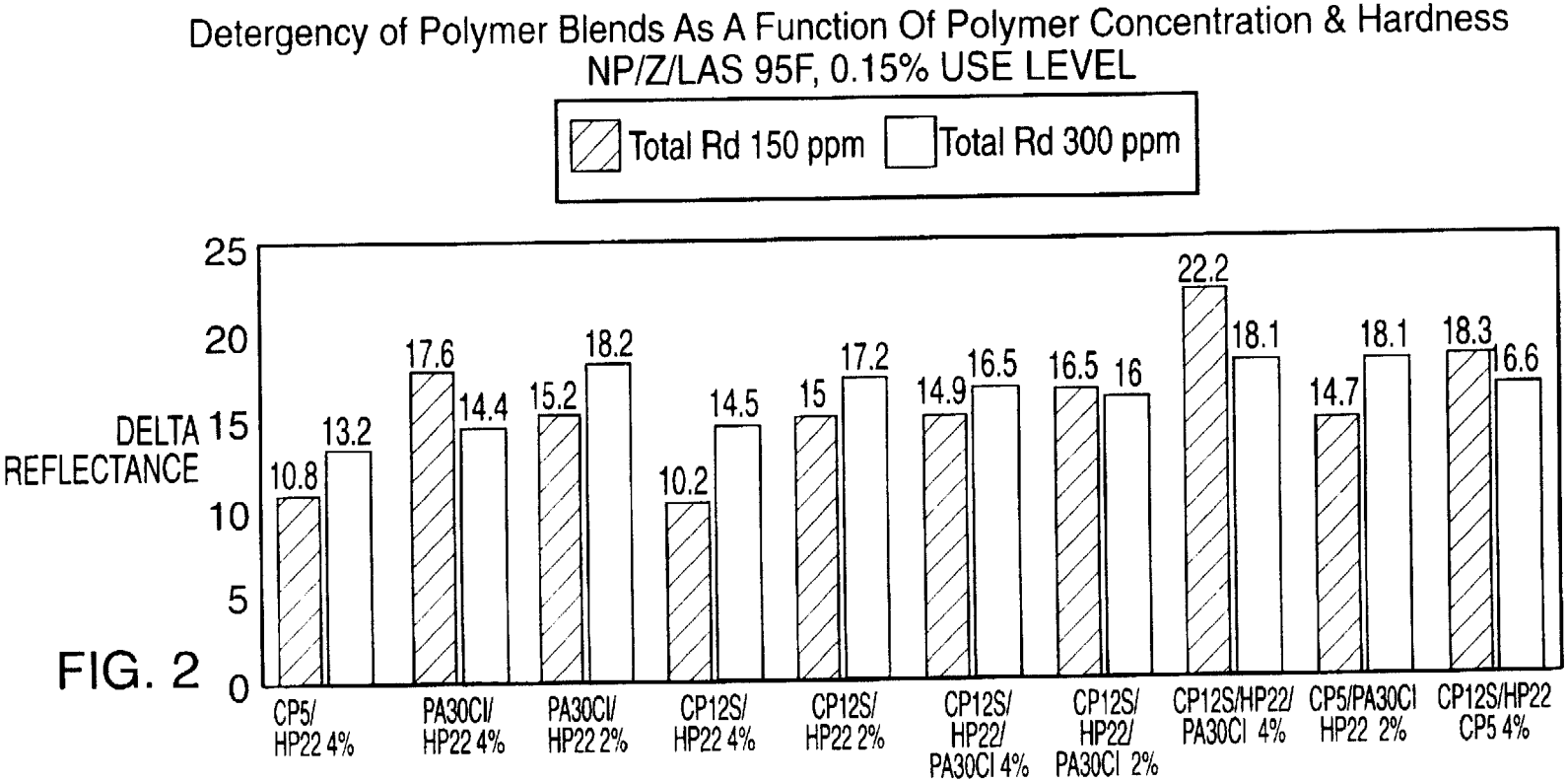
FIG. 2 is a bar chart of the detergency boosting performance of various polymer blends as a function of polymer concentration.

The detergency enhancements shown in TABLES 1 and 2 are further illustrated in a bar-chart form in FIGS. 1 and 2. FIG. 1 shows the cumulative or total detergency enhancement provided by each polymer individually at different polymer and hardness concentrations. Similarly, FIG. 2 shows the cumulative or total detergency enhancement provided by the polymer blends at different total polymer loading as well as different hardness levels according to the various embodiments of the invention.

Figure 3:
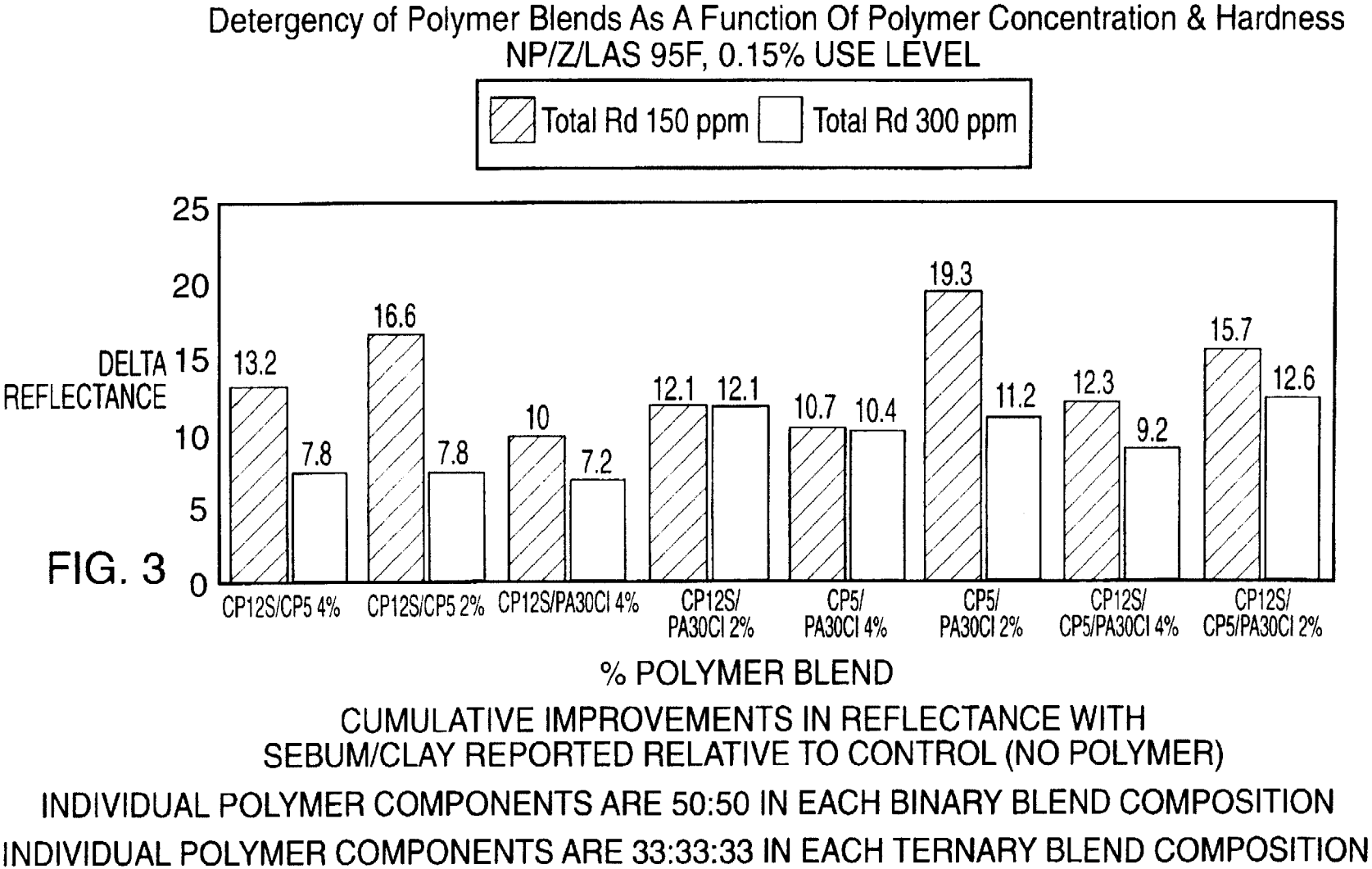
FIG. 3 is a bar chart of the detergency boosting performance of polycarboxylate blends as a function of polymer concentration.

FIG. 3 shows the cumulative or total detergency enhancement provided by certain polymer blends which are not within the scope of the invention at different total polymer loading and hardness levels.

Reviewing TABLES 1 and 2 and FIGS. 1, 2 and 3 the skilled artisan will quickly recognize certain patterns. For example, when any of the polycarboxylates are utilized as detergency boosters alone, either singularly as in FIG. 1 or in binary or ternary blends as in FIG. 3, there is a significant drop in $R_d$ (Delta Reflectance) as water hardness increases from 150 ppm to 300 ppm. Conversely, in FIG. 1 the detergency enhancement of the graft copolymer of polyalkylene oxide with vinyl acetate at 150 ppm is not nearly as high as it is at 300 ppm.

However, as FIG. 2 illustrates, when the preferred graft copolymer of polyalkylene oxide with vinyl acetate is added to the polycarboxylate to produce a polymer blend, there is significant enhancement in detergency boosting, or total $R_d$ at both the 150 and 300 ppm level. One would normally expect that combining a polymer (graft copolymer) which is more effective at 300 ppm with a polymer (polycarboxylate) which is much more effective at 150 ppm would only serve to significantly reduce the cleaning prowess of the resulting polymer blend at the 150 ppm level. One would also expect the converse to be true, that is, one would also expect to see a substantial reduction in the cleaning ability of the polymer blend at 300 ppm as well. As FIG. 2 demonstrates, this is not the case. The polymer blend additives according to various embodiments of the invention exhibit a synergy in detergency boosting over and above any of the individual components alone. Furthermore, the detergency boosting effect is substantially maintained or even increased as the concentration of hardness ions increases from about 150 ppm to about 300 ppm.

As that term is used herein, "substantially maintained" means a total or cumulative $R_d$ reduction of about 4.0 units or even less in going from 150 ppm to 300 ppm, together with an average total or cumulative $R_d$ of at least about 15.0 units. Average cumulative or total $R_d$ is measured by taking the total $R_d$ at 150 ppm for each fabric/stain combination and particular polymer blend additive and averaging that with the total $R_d$ at 300 ppm for the same fabric/stain combination and particular polymer blend additive. Thus, in FIG. 2 the average total $R_d$ for the PA 30 Cl/HP 22 at 2% would be 15.2+18.2/2=16.7.

While the invention has been described in each of its various embodiments, it is to be expected that certain modifications thereto may occur to those skilled in the art without departing from the true spirit and scope of the invention as set forth in the specification and the accompanying claims.

What is claimed is:

1. A laundry detergency boosting polymer blend additive, comprising:

a) from about 10 to 70% of a graft copolymer of polyalkylene oxide with vinyl ester, said graft copolymer having a molecular weight with the range of about 5,000 to 50,000; and b) from about 10 to 70% of at least two polycarboxylates selected from the group consisting of acrylic/maleic

TABLE 1

Detergency Performance Of Polymers at 150 ppm

| Example | Polymer | Sebum/Cotton | Sebum/Poly | Sebum/Blend | Clay/Cotton | Clay/Poly | Clay/Blend | Total Pd |
|---|---|---|---|---|---|---|---|---|
| 1. | CP5 4% | d 1.7 (0.7) | d 3.3 (0.5) | d 5.1 (0.8) | d −0.8 (2.7) | d −0.4 (1.7) | d 0.9 (1.5) | d 10.6 |
| 2. | PA30Cl 4% | d 1.5 (2.0) | d 2.9 (1.0) | d 3.6 (0.5) | d 1.4 (1.4) | d −0.9 (1.0) | d 0.8 (0.4) | d 9.3 |
| 3. | CP-12S 4% | d 3.3 (2.3) | d 0.6 (0.8) | d 2.1 (1.2) | d 0.8 (3.5) | d 0.9 (0.9) | d 1.0 (0.2) | d 8.7 |
| 4. | HP-22 4% | d −0.9 (3.7) | d 0.7 (1.7) | d 0.0 (0.3) | d 0.9 (1.5) | d 0.9 (2.3) | d 1.7 (0.2) | d 3.3 |
| 5. | CP5 2% | d 2.2 (3.6) | d 4.5 (1.2) | d 2.6 (0.9) | d 0.4 (1.6) | d −0.1 (0.6) | d 1.2 (0.2) | d 10.8 |
| 6. | PA30Cl 2% | d 1.0 (2.4) | d 3.0 (2.6) | d 1.2 (0.9) | d 5.5 (0.6) | d 1.7 (0.3) | d 1.1 (0.4) | d 13.5 |
| 7. | CP-12S 2% | d 1.4 (1.6) | d 1.8 (1.8) | d 1.0 (1.8) | d 5.2 (2.1) | d 1.9 (0.2) | d 1.1 (0.4) | d 12.4 |
| 8. | HP-22 2% | d 3.8 (1.6) | d 1.6 (0.5) | d 0.7 (0.2) | d 3.0 (1.6) | d 1.3 (0.9) | d 2.1 (0.7) | d 12.5 |
| 9. | CP5 1.3% | d 0.4 (2.9) | d 3.6 (0.8) | d 2.8 (1.5) | d −2.8 (1.0) | d 0.2 (1.7) | d 0.8 (0.5) | d 5.0 |
| 10. | PA30Cl 1.3% | d 1.1 (5.4) | d 4.9 (2.0) | d 2.8 (1.2) | d 3.4 (2.6) | d 0.3 (0.4) | d 1.0 (0.2) | d 13.5 |
| 11. | CP-12S 1.3% | d 1.3 (0.5) | d 2.2 (1.0) | d 1.2 (0.5) | d 2.6 (1.3) | d 0.8 (2.1) | d 0.9 (0.6) | d 9.0 |
| 12. | HP-22 1.3% | d 1.7 (2.4) | d 3.4 (1.6) | d 2.2 (0.6) | d 0.2 (4.4) | d 2.6 (1.4) | d 1.3 (0.2) | d 11.4 |
| 13. | CP5/HP-22 4% | d 3.6 (1.2) | d 2.1 (1.6) | d 2.4 (0.4) | d 0.5 (1.7) | d 1.0 (1.2) | d 1.2 (0.4) | d 10.8 |
| 14. | PA30Cl/HP-22 4% | d 4.8 (2.7) | d 2.1 (1.0) | d 2.9 (0.7) | d 2.4 (1.2) | d 3.5 (0.4) | d 1.9 (0.6) | d 17.6 |
| 15. | CP-12S/HP-22 4% | d 3.5 (1.8) | d 0.3 (0.4) | d 1.8 (0.9) | d 3.0 (1.3) | d 0.2 (1.5) | d 1.4 (0.6) | d 10.2 |
| 16. | CP12S/HP22/PA39Cl 4% | d 4.6 (2.1) | d 1.7 (1.0) | d 2.6 (1.6) | d 4.2 (0.5) | d 0.3 (0.7) | d 1.5 (0.4) | d 14.9 |
| 17. | CP5/PA30Cl/HP22 4% | d 5.8 (0.8) | d 3.6 (0.6) | d 4.5 (0.6) | d 5.5 (1.2) | d 1.3 (0.6) | d 1.5 (1.0) | d 22.2 |
| 18. | CP12S/HP22/CP5 4% | d 4.9 (1.7) | d 2.2 (1.7) | d 3.3 (0.8) | d 5.1 (1.5) | d 1.3 (0.7) | d 1.5 (0.6) | d 18.3 |
| 19. | PA30Cl/HP22 2% | d 3.0 (2.5) | d 2.6 (1.5) | d 2.0 (1.2) | d 3.9 (2.6) | d 1.5 (0.3) | d 2.2 (0.8) | d 15.2 |
| 20. | CP12S/HP22 2% | d 2.4 (1.2) | d 2.0 (1.3) | d 2.4 (0.9) | d 5.1 (2.4) | d 1.1 (1.8) | d 2.0 (0.2) | d 15.0 |
| 21. | CP12S/HP22/PA30Cl 2% | d 2.6 (1.7) | d 3.2 (1.7) | d 2.2 (0.7) | d 5.2 (2.0) | d 1.5 (0.4) | d 1.8 (1.2) | d 16.5 |
| 22. | CP5/PA30Cl/HP22 2% | d 3.5 (2.8) | d 4.2 (1.0) | d 4.2 (0.6) | d 1.2 (1.3) | d −0.1 (1.2) | d 1.7 (0.3) | d 14.7 |

Sokalan CP5 — Acrylic/Maleic copolymer MW = 70,000
Sokalan PA30Cl — Polyacrylic acid sodium salt MW = 8000
Sokalan CP12S — Acrylic/Maleic copolymer MW = 3000
Sokalan HP22 — Graft polymer of polyalkylene oxide with vinyl acetate MW = 24000
Delta Reflectance(d): The numbers in each column show the increase in reflectance values relative to a detergent composition without polymer
The numbers in parentheses denote the 95% confidence intervals for each measurement
The last column shows the cumulative improvements in reflectance across six fabric/stain combinations

TABLE 2

Detergency Performance Of Polymers at 300 ppm

| Example | Polymer | Sebum/Cotton | Sebum/Poly | Sebum/Blend | Clay/Cotton | Clay/Poly | Clay/Blend | Total Pd |
|---|---|---|---|---|---|---|---|---|
| 1. | CP5 4% | d 1.2 (0.7) | d 2.4 (1.1) | d 0.9 (1.3) | d 1.2 (1.5) | d 0.5 (0.4) | d 0.6 (0.8) | d 6.8 |
| 2. | PA30Cl 4% | d 0.5 (1.2) | d 2.1 (0.5) | d 2.2 (0.7) | d 2.7 (1.1) | d −0.1 (1.8) | d 0.6 (0.6) | d 8.0 |
| 3. | CP-12S 4% | d 1.0 (1.8) | d 0.9 (0.3) | d 0.3 (1.4) | d 1.6 (2.0) | d 1.4 (2.2) | d 0.3 (0.5) | d 5.5 |
| 4. | HP-22 4% | d 3.2 (1.5) | d 3.5 (0.4) | d 3.3 (1.1) | d 2.7 (1.6) | d 0.6 (0.3) | d 1.6 (0.8) | d 14.9 |
| 5. | CP5 2% | d 0.0 (0.9) | d 1.9 (1.0) | d 0.6 (0.7) | d 0.1 (2.0) | d −0.3 (2.8) | d 0.1 (0.3) | d 2.4 |
| 6. | PA30Cl 2% | d 0.2 (1.2) | d 1.4 (0.6) | d 0.8 (1.2) | d 4.6 (2.2) | d 3.0 (0.5) | d 0.9 (0.6) | d 10.9 |
| 7. | CP-12S 2% | d 0.6 (0.6) | d 1.6 (0.9) | d 0.3 (0.8) | d 5.8 (1.8) | d 1.9 (1.2) | d 0.9 (0.8) | d 1.3 |
| 8. | HP-22 2% | d 3.8 (1.4) | d 3.4 (0.5) | d 1.6 (1.1) | d 2.9 (1.4) | d 0.3 (2.4) | d 1.9 (0.7) | d 13.9 |
| 9. | CP5 1.3% | d 0.4 (0.5) | d 0.5 (1.0) | d 0.1 (0.6) | d 0.2 (0.9) | d −0.6 (1.1) | d −2.3 (0.2) | d −0.8 |
| 10. | PA30Cl 1.3% | d −1.0 | d 0.6 | d 1.4 | d 4.4 | d 1.1 (1.9) | d 2.6 (2.4) | d 9.1 |
| 11. | CP-12S 1.3% | d 0.0 (1.6) | d 0.3 (1.0) | d 1.4 (2.2) | d 4.2 (1.2) | d 0.4 (0.9) | d 1.7 (1.2) | d 8.0 |
| 12. | HP-22 1.3% | d 1.7 (2.4) | d 3.1 (1.0) | d 2.6 (0.8) | d 1.4 (1.7) | d 1.4 (0.4) | d 0.9 (2.6) | d 11.1 |
| 13. | CP5/HP-22 4% | d 3.6 (2.4) | d 3.9 (1.2) | d 1.2 (1.6) | d 1.9 (1.3) | d 1.2 (1.9) | d 1.4 (0.4) | d 13.2 |
| 14. | PA30Cl/HP-22 4% | d 3.7 (0.5) | d 3.8 (1.1) | d 1.7 (0.5) | d 2.9 (3.0) | d 1.2 (1.2) | d 1.1 (0.5) | d 14.4 |
| 15. | CP-12S/HP-22 4% | d 3.5 (0.9) | d 3.2 (1.0) | d 3.3 (0.6) | d 2.1 (2.3) | d 1.4 (0.5) | d 1.0 (0.7) | d 14.5 |
| 16. | CP12S/HP22/PA39Cl 4% | d 3.7 (0.5) | d 2.5 (1.1) | d 3.5 (0.7) | d 4.2 (2.0) | d 2.2 (1.4) | d 0.4 (0.5) | d 16.5 |
| 17. | CP5/PA30Cl/HP22 4% | d 3.6 (1.3) | d 3.7 (1.5) | d 3.4 (1.4) | d 3.6 (1.2) | d 2.4 (1.1) | d 1.2 (0.4) | d 18.1 |
| 18. | CP12S/HP22/CP5 4% | d 3.9 (1.8) | d 3.0 (0.8) | d 3.1 (0.4) | d 2.3 (0.7) | d 2.9 (1.0) | d 1.4 (0.8) | d 16.6 |
| 19. | PA30Cl/HP22 2% | d 3.3 (1.5) | d 2.4 (0.7) | d 2.2 (1.1) | d 5.5 (4.1) | d 2.6 (1.8) | d 2.2 (0.8) | d 16.2 |
| 20. | CP12S/HP22 2% | d 1.3 (3.6) | d 2.7 (1.1) | d 3.0 (0.8) | d 6.2 (2.4) | d 2.2 (1.8) | d 1.8 (0.7) | d 17.2 |
| 21. | CP12S/HP22/PA30Cl 2% | d 1.3 (2.2) | d 2.5 (0.8) | d 3.2 (1.4) | d 5.8 (4.5) | d 1.6 (2.3) | d 1.6 (0.9) | d 16.0 |
| 22. | CP5/PA30Cl/HP22 2% | d 2.6 (1.8) | d 4.7 (1.6) | d 3.6 (2.1) | d 3.7 (2.4) | d 1.9 (2.4) | d 1.6 (1.1) | d 18.1 |

acid copolymers having a molecular weight within the range of about 1,000 to 100,000, and polyacrylic acid having a molecular weight with the range of about 1,000 to 100,000, wherein said polycarboxylates comprise either at least one said acrylic/maleic acid copolymer and one said polyacrylic acid or at least two acrylic/maleic acid copolymers of different molecular weights;

said polymer blend being effective in water having an ion hardness in the range of about 50 to 500 ppm.

2. The composition as claimed in claim 1, wherein the detergency boosting performance of said polymer blend is substantially maintained or increased as the concentration of said hardness ions in water is increased.

3. A method for improving the cleaning power of laundry formulations in a water hardness range of 50 to 500 ppm, which comprises adding an effective amount of a detergency boosting polymer blend additive, said polymer blend additive comprising:

(a) from about 10 to 70% of a graft copolymer of polyalkylene oxide with vinyl ester, said graft copolymer having a molecular weight with the range of about 5,000 to 50,000; and b) from about 10 to 70% of at least two polycarboxylates selected from the group consisting of acrylic/maleic acid copolymers having a molecular weight within the range of about 1,000 to 100,000, and polyacrylic acid having a molecular weight with the range of about 1,000 to 100,000, wherein said polycarboxylates comprise either at least one said acrylic/maleic acid copolymer and one said polyacrylic acid or at least two acrylic/maleic acid copolymers of different molecular weights.

4. The composition as claimed in claim 2, said composition being added to a laundry detergent formulation in an amount of from about 0.1% to 10%, based upon the weight of said detergent formulation.

5. The composition as claimed in claim 4, wherein said polymer blend comprises:

a) a graft copolymer of polyalkylene oxide with vinyl acetate, said graft copolymer having a molecular weight within the range of about 10,000 to 35,000; and b) at least one polycarboxylate selected from the group consisting of acrylic/maleic acid copolymers having a molecular weight within the range of about 2,000 to 85,000, and polyacrylic acid having a molecular weight of from about 1,000 to 20,000.

6. The composition as claimed in claim 5, comprising about 20 to 60% of component a) and about 20 to 60% of component b).

7. The composition as claimed in claim 6, said composition being added to a laundry detergent formulation in an amount of from about 0.5 to 7.5%.

8. The composition as claimed in claim 7, wherein said water hardness is in the range of about 100 to 400 ppm.

9. The composition as claimed in claim 8, wherein said polymer blend comprises:

a) a graft copolymer of polyalkylene oxide with vinyl acetate, said graft copolymer having a molecular weight within the range of about 15,000 to 30,000; and b) at least one polycarboxylate selected from the group consisting of acrylic/maleic acid copolymers having a molecular weight within the range of about 2,000 to 85,000, and polyacrylic acid having a molecular weight of from about 3,000 to 10,000.

10. The composition as claimed in claim 9, wherein said water hardness is in the range of about 150 to 400 ppm.

11. The composition as claimed in claim 10, said composition being added to a laundry detergent formulation in an amount of from about 1 to 5%.

12. The composition as claimed in claim 11, wherein said water hardness is in the range of about 150 to 300 ppm.

13. The composition as claimed in claim 12, wherein said polymer blend comprises:

a) a graft copolymer of polyalkylene oxide with vinyl acetate, said graft copolymer having a molecular weight of about 24,000; and b) at least one polycarboxylate selected from the group consisting of acrylic/maleic acid copolymers having a molecular weight within the range of about 2,000 to 85,000, and polyacrylic acid having a molecular weight of from about 3,000 to 10,000.

14. The composition as claimed in claim 13, wherein said polymer blend comprises:

a) a graft copolymer of polyalkylene oxide with vinyl acetate, said graft copolymer having a molecular weight of about 24,000; and b) at least one polycarboxylate selected from the group consisting of acrylic/maleic acid copolymers having a molecular weight within the range of about 2,000 to 85,000, and polyacrylic acid having a molecular weight of about 8,000.

15. The composition as claimed in claim 14, wherein said polymer blend comprises:

a) a graft copolymer of polyalkylene oxide with vinyl acetate, said graft copolymer having a molecular weight of about 24,000; and b) at least one polycarboxylate selected from the group consisting of acrylic/maleic acid copolymers having a molecular weight of about 3,000 and a molecular weight of about 70,000, and polyacrylic acid having a molecular weight of about 8,000.

16. The composition as claimed in claim 15, wherein component a) comprises about 50% of said blend, and component b) comprises about 50% of said blend.

17. A laundry detergency boosting polymer blend additive, comprising:

a) from about 10 to 70% of a graft copolymer of polyalkylene oxide with vinyl ester, said graft copolymer having a molecular weight with the range of about 5,000 to 50,000; and b) at least one polycarboxylate selected from the group consisting of acrylic/maleic acid copolymers having a molecular weight within the range of about 1,000 to 100,000; and c) polyacrylic acid having a molecular weight with the range of about 1,000 to 100,000;

said polymer blend being effective in water having an ion hardness in the range of about 50 to 500 ppm.

18. The composition as claimed in claim 17, said composition being added to a laundry detergent formulation in an amount of from about 0.1 to 10%, based upon the weight of said detergent formulation.

19. The composition as claimed in claim 18, comprising about 20 to 50% of component a), about 20 to 50% of component b) and about 20 to 50% of component c).

20. The composition as claimed in claim 19, comprising:

a) a graft copolymer of polyalkylene oxide with vinyl acetate, said graft copolymer having a molecular weight of about 24,000; and b) at least one polycarboxylate selected from the group consisting of acrylic/maleic acid copolymers having a molecular weight of about 3,000 and a molecular weight of about 70,000; and c) polyacrylic acid having a molecular weight of about 8,000;

said polymer blend being effective in water having an ion hardness in the range of about 50 to 500 ppm.

21. The composition as claimed in claim 20, wherein said water hardness is in the range of about 50 to 450 ppm.

22. The composition as claimed in claim 21, wherein said water hardness is in the range of about 150 to 300 ppm.

23. The composition as claimed in claim 22, wherein the detergency boosting performance of said polymer blend additive in said detergent formulation is substantially maintained or increased as the concentration of said hardness ions in water is increased.

24. A laundry detergent formulation, comprising detergent active matter, one or more electrolytes or builders, and an effective amount of a detergency boosting polymer blend additive, said polymer blend additive comprising:

a) from about 10 to 70% of a graft copolymer of polyalkylene oxide with vinyl ester, said graft copolymer having a molecular weight with the range of about 5,000 to 50,000; and b) from about 10 to 70% of at least two polycarboxylates selected from the group consisting of acrylic/maleic acid copolymers having a molecular weight within the range of about 1,000 to 100,000, and polyacrylic acid having a molecular weight with the range of about 1,000 to 100,000, wherein said polycarboxylates comprise either at least one said acrylic/maleic acid copolymer and one said polyacrylic acid or at least two acrylic/maleic acid copolymers of different molecular weights;

said polymer blend being effective in water having an ion hardness in the range of about 50 to 500 ppm.

25. The composition as claimed in claim 24, wherein the detergency boosting performance of said polymer blend additive in said detergent formulation is substantially maintained or increased as the concentration of said hardness ions in water is increased.

26. A method for improving the detergency properties of laundry formulations, which comprises adding an effective amount of a detergency boosting polymer blend additive, said polymer blend additive comprising:

a) from about 10 to 70% of a graft copolymer of polyalkylene oxide with vinyl ester, said graft copolymer having a molecular weight with the range of about 5,000 to 50,000; and b) from about 10 to 70% of at least two polycarboxylates selected from the group consisting of acrylic/maleic acid copolymers having a molecular weight within the range of about 1,000 to 100,000, and polyacrylic acid having a molecular weight with the range of about 1,000 to 100,000, wherein said polycarboxylates comprise either at least one said acrylic/maleic acid copolymer and one said polyacrylic acid or at least two acrylic/maleic acid copolymers of different molecular weights;

said polymer blend being effective in water having an ion hardness in the range of about 50 to 500 ppm.

27. The method as claimed in claim 26, wherein the detergency boosting performance of said polymer blend additive in said detergent formulation is substantially maintained or increased as the concentration of said hardness ions in water is increased.

28. The method according to claim 3, wherein the water hardness is about 300.

29. The method according to claim 3, wherein the water hardness is about 500.

* * * * *